US007546870B1

(12) United States Patent
Dotson

(10) Patent No.: US 7,546,870 B1
(45) Date of Patent: Jun. 16, 2009

(54) METHOD AND SYSTEM FOR REMOVING LIQUID FROM A GAS WELL

(75) Inventor: Bryan D. Dotson, Houston, TX (US)

(73) Assignee: BP Corporation North America Inc., Warrenville, IL (US)

( * ) Notice: Subject to any disclaimer, the term of this patent is extended or adjusted under 35 U.S.C. 154(b) by 0 days.

(21) Appl. No.: 12/117,003

(22) Filed: May 8, 2008

(51) Int. Cl.
*E21B 43/00* (2006.01)

(52) U.S. Cl. ..... 166/105; 417/46; 417/904

(58) Field of Classification Search ..... 166/105, 166/265; 60/641.2, 641.3, 641.4, 641.6; 417/426, 427
See application file for complete search history.

(56) References Cited

U.S. PATENT DOCUMENTS 4,290,266 A * 9/1981 Twite et al. ..... 60/641.2
4,325,681 A * 4/1982 Matthews ..... 417/379
4,531,593 A * 7/1985 Elliott et al. ..... 175/71
5,517,464 A * 5/1996 Lerner et al. ..... 367/84
5,860,795 A * 1/1999 Ridley et al. ..... 417/403
6,259,165 B1 * 7/2001 Brewington ..... 290/1 A
7,013,645 B2 * 3/2006 Brewington ..... 60/641.2
7,204,314 B2 * 4/2007 Lauritzen et al. ..... 166/369
2003/0230086 A1 * 12/2003 Brewington ..... 60/641.1

* cited by examiner

*Primary Examiner*—David J Bagnell
*Assistant Examiner*—James Sayre
(74) *Attorney, Agent, or Firm*—F. Lindsey Scott; John L. Wood

(57) ABSTRACT

A method and system for the removal of produced liquid from a gas well extending from an earth surface through a subterranean gas-bearing formation using a thermodynamic cycle.

18 Claims, 1 Drawing Sheet

METHOD AND SYSTEM FOR REMOVING LIQUID FROM A GAS WELL

FIELD OF THE INVENTION

The present invention relates to the removal of undesired liquid from a gas well extending from an earth surface through a subterranean gas-bearing formation.

BACKGROUND OF THE INVENTION

In many gas wells the production of liquids, principally water, is a problem. The gas wells may have a limited flow of produced water from a gas-bearing or other formation penetrated by the production well or both. This liquid, if allowed to accumulate in the well, may rise to a level in the well above the level of the gas-producing formation. In such instances the liquid level may exert a substantial pressure relative to the gas pressure so that the production of gas from the gas-bearing formation is limited or shut-off. The liquid may contain traces of hydrocarbons and the like but is typically primarily water.

The removal of this liquid has long been a problem. The installation of a pump and the operation and maintenance of the pump may constitute an expense which may approach or even exceed the net value of the gas. The presence of liquid in gas wells has inhibited the production of gas from many gas-bearing formations.

Since the productivity of many gas wells is quite low, often less than 100,000 standard cubic feet per day, a low cost deliquification method is needed. A stand-alone system, not requiring electrical or other energy for operation, would be highly desirable. A continuing search has been directed to the development of such a system.

SUMMARY OF THE INVENTION

The present invention comprises a method for removing a produced liquid from a gas well extending from an earth surface through a subterranean gas-bearing formation, the method comprising: powering a subterranean pump positioned in the gas well below a produced liquid level with a power fluid liquid, which is a vapor at formation temperature at the depth of the subterranean pump and liquid at the earth surface; supplying the power fluid liquid to the subterranean pump through a pipe extending upwardly from the subterranean pump to the earth surface, the power fluid liquid being pressurized to a pressure greater than the pressure in the gas well at the depth of the subterranean pump; pumping the produced liquid from the gas well with the subterranean pump; recovering power fluid liquid discharged from the subterranean pump; vaporizing the recovered power fluid liquid in the gas well to produce a power fluid vapor; recovering the power fluid vapor at the earth surface; and condensing the power fluid vapor to produce the power fluid liquid for return to the pipe extending upwardly from the subterranean pump.

The invention further comprises a system for removing a produced liquid from a gas well extending from an earth surface through a subterranean gas-bearing formation, the system comprising: a pump positioned below a first produced liquid level in the gas well; a produced liquid outlet line from the pump in fluid communication with a produced liquid inlet into the pump and the earth surface and adapted to pass produced liquid from the pump to the earth surface; a power fluid liquid line in fluid communication with a power fluid liquid inlet into the pump and a source of a power fluid liquid, the source being above the power fluid liquid inlet a sufficient distance to hydrostatically pressurize the power fluid liquid to power the pump; a heat exchanger in the well having a power fluid vapor outlet and in fluid communication with a power fluid liquid outlet from the pump to at least partially vaporize the power fluid liquid, the power fluid liquid being volatile and a vapor at a well temperature at the pump level to produce a power fluid vapor by vaporizing the power fluid liquid; and a power fluid vapor line in fluid communication with a heat exchanger power fluid vapor outlet and a heat exchanger/condenser positioned on the earth surface to cool the power fluid vapor to produce the power fluid liquid for passage to the source of the power fluid liquid.

BRIEF DESCRIPTION OF THE DRAWINGS

The FIGURE is a schematic diagram of a cased well for the production of gas from a subterranean gas-bearing formation.

DISCUSSION OF PREFERRED EMBODIMENTS

Figure 1:
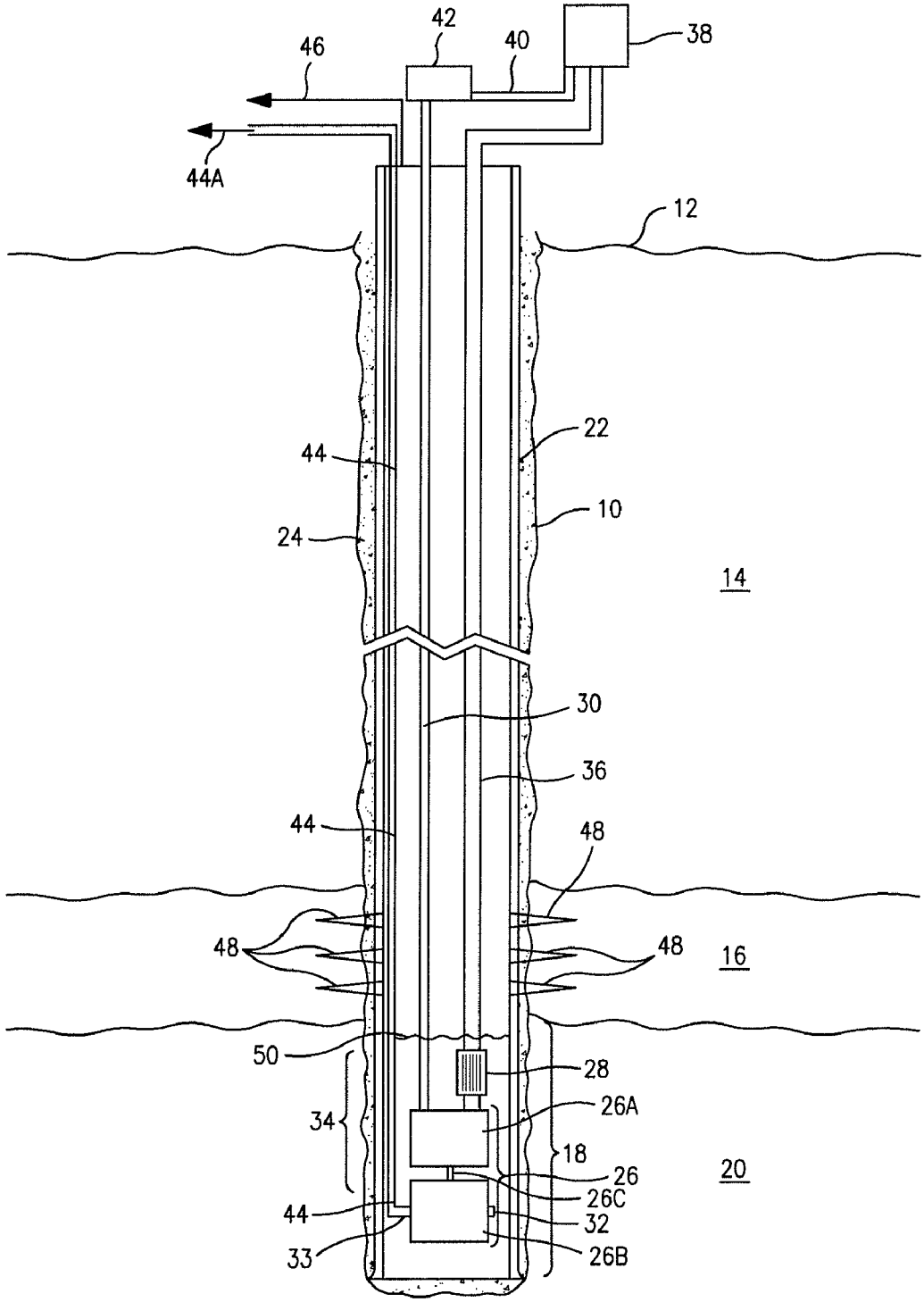

The term "power fluid" as used herein refers to a volatile liquid which is a gas (vapor) at formation temperature and a liquid at the earth surface temperature.

In the practice of the present invention, a subterranean pump is positioned in a gas well beneath a produced liquid level in a gas-bearing formation and provided with a stream of power fluid liquid which is contained in a pipe, which may be insulated, extending to the surface of the earth. This pipe provides the power fluid liquid at a substantial pressure at the pump depth. The power provided by the hydrostatic head in the pipe extending to the surface is sufficient to operate the pump to pump a produced liquid, typically primarily water, from the gas well. The power fluid liquid discharged from the pump is recovered and vaporized in the well for passage through a line to the earth surface to a condenser where it is condensed to produce the power fluid liquid for recycle to the pump. Produced gas is produced from the well as known to those skilled in the art. While not shown in the FIGURE, a wellhead, as well known to those skilled in the art, is generally included on the gas well for necessary control and regulation of the recovery of produced gas. The produced liquid removed from the well may contain traces of hydrocarbons, acid gases and a variety of other materials as known to those skilled in the art. The primary constituent of the produced liquid is water which constitutes the bulk of the produced liquid to be removed.

In the FIGURE, a well 10 is shown extending from an earth surface 12 through an overburden 14, through a gas-bearing formation 16 and extending a distance 18 beneath formation 16. The underlying formation 20 may be a liquid-bearing formation or a non-liquid-bearing formation. The well shown is a cased well, including a casing 22 positioned in well bore 10 by cement 24. Perforations 48 are shown through casing 22 to permit production of gas from gas-bearing formation 16. A pump assembly 26 comprised of a pump driver 26A, a power rod 26C, and a produced liquid pump 26B, is positioned, as shown, beneath a produced liquid level 50. The pump assembly 26 may be supported in the well by any desired method and may be supported in the well by power fluid liquid pipe 30. Power fluid liquid pipe 30 extends from earth surface 12 to pump assembly 26 and may be an insulated pipe. The pump assembly 26 may be positioned above the perforations if desired. This positioning may result in separation problems with the mixture of produced liquid and produced gas. The pump will pump down to the net positive suction required level. Desirably the pump is positioned to pump produced liquid in an amount sufficient to maintain a selected liquid level in well 10.

A power fluid liquid, such as propane, butane, halogenated hydrocarbon refrigerants, mixtures of hydrocarbon liquids and the like may be supplied as a power fluid liquid through pipe 30. Preferably the power fluid liquid has a boiling point at one atmosphere pressure from about −100 to about 50° F. The power fluid is delivered as a liquid via a line 30 to the pump driver 26A. Pump driver 26A may be any device that converts fluid power to mechanical power, such as a turbine, a progressing cavity motor, a piston motor or a diaphragm motor. The power fluid liquid passed through pipe 30 is passed through pump driver 26A resulting in mechanical work being passed by the power rod 26C to the produced liquid pump 26B. Other methods of power transmission may be employed, included but not limited to electrical or hydraulic. After the power fluid liquid passed through pipe 30 has passed into and functioned for the operation of pump driver 26A, it is discharged through a heat exchanger 28 to form a vapor and passed back to the earth surface through a line 36 which passes it to a condenser 38, which condenses the power fluid liquid vapor back to the power fluid liquid which is passed through a power fluid liquid line 40 to line 30 or to an optional storage tank 42. Storage tank 42 facilitates control of the operation of the well, but is optional since the system can be operated with line 40 directly passing power fluid liquid to pipe 30. The produced liquid pump 26B includes a produced liquid intake 32 to allow the inflow of produced liquid from well 10 and a pump outlet 33 for the discharge of produced liquid from produced liquid pump 26B via a line 44 which is adapted for the passage of the produced liquid to the surface, as shown by line 44 and arrow 44A. The produced liquid pump may be a diaphragm pump, a progressing cavity pump, a piston pump or any other suitable pump could be used. The pump is desirably placed at a distance 34 beneath liquid level 50 sufficient to provide a net positive suction head sufficient for operation of the pump. This distance is typically from about 10 to about 30 feet. Produced liquid line 44 passes the pumped produced liquids to the earth surface as shown by line 44A with produced gas production being shown schematically by an arrow 46.

In the operation of well 10 as shown, to a certain extent, the system is self-regulating in that line 36 is exposed to greater or lesser lengths to the produced liquid beneath level 50 which tends to heat the power fluid liquid passed through line 30 to a greater or lesser degree thereby facilitating the vaporization of the power fluid liquid to a greater or lesser degree. The greater the length of line 36 exposed to produced liquids below level 50, the greater the heating of the power fluid liquid thus producing the power fluid vapor in line 36 at a higher temperature, thereby facilitating its passage to the surface.

In the operation of the produced liquid removal system shown in the FIGURE, the system is operated without the need for additional power from any external source. The liquid hydrostatic head in pipe 30 with the power fluid liquid being vaporized and recovered in condenser 38 for recycle to pipe 30 constitutes a thermodynamic cycle which is self-powered. This system is relatively self-regulating although if desired a control valve (not shown) connected to limit the flow of power fluid liquid into pipe 30 can be used to control the pumping rate of produced liquid from the well. This can readily be implemented by a level sensor or by other sensors positioned in the well as desired. The control can be a simple system which may be powered by a battery, solar power, or both, so that it is not necessary to deliver additional energy to the system, either as a fuel for combustion or as electricity. The use of such controllers is well known to those in the art and is frequently implemented in the production of fluids from beneath the surface of the earth.

To illustrate the invention, the following example is provided. The example demonstrates the use of thermodynamic power system useful in the present invention.

EXAMPLE

In a 10,000 foot well with a 200° F. bottom-hole temperature and using condensation with heat exchange with atmospheric air the following results are shown. The condenser produces liquid propane, supplied to the well as a power fluid liquid at 120° F. and 230 psig. The propane is directed down an insulated pipe 30 sized for relatively low friction losses. At the bottom of this liquid downcomer the propane conditions will be about 140° F. and 2500 psig. The pump driver 26A includes a power piston rod 26C which uses the power fluid (propane) to drive a rod connected to any appropriate produced liquid pump 26B. A diaphragm or plunger pump, or other pump could be substituted. Alternatively, a rotational engine such as a progressing cavity device could be used to drive a rotational pump such as a centrifugal or progressing cavity pump. The pressure differential of 2500 to 500 psig is available for the extraction of work and the temperature differential of the 200° F. wellbore to the 140° F. working fluids is used to vaporize the propane. The heat for vaporization is obtained from both the pumped fluid (produced fluid) and from conduction from the subterranean formation rock into the produced liquid surrounding the pump. The propane is entirely vaporized in the heat exchanger to produce vaporized propane at 180° F. and 450 psig. The vaporized propane is passed to an insulated riser (line 36) which is insulated to the extent required to prevent propane condensation in the pipe. The vaporized propane arrives at the earth surface at about 160° F. and 235 psig and is condensed using atmospheric air to liquid propane at 120° F. and about 230 psig and routed back to the liquid down comer to repeat the cycle. A small liquid accumulator may be used if desired.

The foregoing Example illustrates the operation of the invention shown in the FIGURE, although it is recognized that additional power as identified hereinabove can also be used. This system does not require external power for its operation and operates on a thermodynamic cycle which is completed using only air as a heat exchange media. Additional or other heat exchange media could be used but air is readily available and may be used without fans or other powered equipment.

In the Example set forth above, it is estimated that approximately 150 pounds per hour (0.3 gallons per minute) of produced liquid may be removed from the well. This is roughly equivalent to the removal of ten barrels per day of produced liquid from the well. It is considered that this invention may be effective to remove up to about 200 barrels per day of produced liquid from a well and it is preferred that the amount of produced liquid removed be no more than about 50 barrels per day. Desirably the well is at least about 560 feet deep.

As well known to those skilled in the art, the temperature of subterranean formations tends to increase with depth so that when deeper formations are treated by the present invention, a greater temperature differential exists for the vaporization and use of the differential temperature energy.

Only a cased well has been shown in the FIGURE. Uncased wells are equally suitable for treatment according to the present invention Further, it is noted that while well 10 extends beneath the gas-producing zone for a substantial distance, this is normally the practice since it is generally considered desirable to have some space for the accumulation of debris, etc. in the bottom of the well below the producing formation(s). By use of the present invention, this space beneath the gas-bearing formation can be used for the positioning of the pump since this space is rarely filled with debris or other matter during production operations.

While the present invention has been described by reference to certain of its preferred embodiments, it is pointed out that the embodiments described are illustrative rather than limiting in nature and that many variations and modifications are possible within the scope of the present invention. Many such variations and modifications may be considered obvious and desirable by those skilled in the art based upon a review of the foregoing description of preferred embodiments.

What is claimed is:

1. A method for removing a produced liquid from a gas well extending from an earth surface through a subterranean gas-bearing formation, the method comprising:

a) powering a subterranean pump positioned in the gas well below a produced liquid level with a power fluid liquid, which is a vapor at a formation temperature at the depth of the subterranean pump and a liquid at the earth surface temperature;

b) supplying the power fluid liquid to the subterranean pump through a pipe extending upwardly from the subterranean pump to the earth surface, the power fluid liquid being pressurized to a pressure greater than the pressure in the gas well at the depth of the subterranean pump;

c) pumping the produced liquid from the gas well with the subterranean pump;

d) recovering power fluid liquid discharged from the subterranean pump;

e) vaporizing the recovered power fluid liquid in the gas well to produce the power fluid vapor;

f) recovering the power fluid vapor to the earth surface; and, g) condensing the power fluid vapor to produce the power fluid liquid for return to the pipe extending upwardly from the subterranean pump.

2. The method of claim 1 wherein the power fluid liquid is pressurized by hydrostatic pressure in the pipe extending upwardly from the subterranean pump.

3. The method of claim 1 wherein the recovered power fluid liquid is vaporized in a subterranean heat exchanger.

4. The method of claim 1 wherein the amount of produced liquid removed is an amount sufficient to maintain the produced liquid level at a selected height in the gas well.

5. The method of claim 1 wherein the produced liquid level is maintained at a level sufficient to maintain the net positive suction head required for operation of the subterranean pump.

6. The method of claim 1 wherein the produced liquid level in the well is controlled to a level below gas inlets into the well and at a level sufficient to maintain the net positive suction head required for operation of the subterranean pump.

7. A system for removing a produced liquid from a gas well extending from an earth surface through a subterranean gas-bearing formation, the system comprising:

a) a pump positioned below a first produced liquid level in the gas well;

b) a produced liquid outlet line from the pump in fluid communication with a produced liquid inlet into the pump and the earth surface and adapted to pass the produced liquid from the pump to the earth surface;

c) a power fluid liquid line in fluid communication with a power fluid liquid inlet into the pump and a source of a power fluid liquid, the source being above the power fluid liquid inlet a sufficient distance to hydrostatically pressurize the power fluid liquid to power the pump;

d) a heat exchanger in the well having a power fluid vapor outlet and in fluid communication with a power fluid liquid outlet from the pump to at least partially vaporize the power fluid liquid, the power fluid liquid being volatile and a vapor at a well temperature at the pump level to produce a power fluid vapor by vaporizing the power fluid liquid; and, e) a power fluid vapor line in fluid communication with a heat exchanger power fluid vapor outlet and a heat exchanger/condenser positioned on the earth surface to cool the power fluid vapor to produce the power fluid liquid for passage to the source of the power fluid liquid.

8. The system of claim 7 wherein the pump is positioned in the well at a pump level beneath a produced liquid level sufficient to provide a net positive suction head required for operation of the pump.

9. The system of claim 8 wherein the pump is positioned at least 10 feet below the produced liquid level.

10. The system of claim 7 wherein the power fluid liquid line extends to the earth surface and is insulated.

11. The system of claim 10 wherein the power fluid liquid line is filled with the power fluid liquid to the earth surface.

12. The system of claim 10 wherein the pump level is at least about 500 feet below the earth surface.

13. The system of claim 7 wherein the heat exchanger/condenser is positioned to cool the power fluid vapor by heat exchange with air in an air heat exchanger to produce the power fluid liquid.

14. The system of claim 7 wherein the power fluid liquid is selected from the group consisting of ethane, butane, propane, halogenated refrigerants and blends of hydrocarbons containing from 2 to about 4 carbon atoms.

15. The system of claim 7 wherein the source of the power fluid liquid comprises a tank in fluid communication with the power fluid liquid line and the heat exchanger/condenser.

16. The system of claim 7 wherein the power fluid liquid has a boiling point at one atmosphere pressure from about −100 to about 50° F.

17. The system of claim 7 wherein the gas well is a cased well.

18. The system of claim 7 wherein the gas well is an uncased well.

* * * * *